United States Patent [19]

Blankschein

[11] 3,951,460

[45] Apr. 20, 1976

[54] METHOD OF MANUFACTURING BRUSHES AND THE LIKE

[76] Inventor: Werner Blankschein, Ohlauerstrasse 2, 8 Munich 50, Germany

[22] Filed: Dec. 14, 1972

[21] Appl. No.: 315,029

[52] U.S. Cl. ..... 300/21
[51] Int. Cl.[2] ..... A46B 15/00
[58] Field of Search ..... 300/21; 425/250, 805; 15/244 R, 244 C, 244 CH

[56] References Cited

UNITED STATES PATENTS

| | | | |
|---|---|---|---|
| 2,175,487 | 10/1939 | Stall | 300/21 X |
| 2,860,011 | 11/1958 | Dunn | 300/21 |
| 2,923,035 | 2/1960 | Schwartz | 425/805 |
| 3,568,235 | 3/1971 | Aston | 300/21 |

*Primary Examiner*—Granville Y. Custer, Jr.
*Attorney, Agent, or Firm*—Melvin A. Crosby

[57] ABSTRACT

A method of manufacture of a plurality of brushes having heads of foam plastic, the heads of the plurality being produced simultaneously by stamping and securing around the head end of each brush handle. Various shapes of brush head can be manufactured, and the head end of the handle can be sized and shaped as desired to produce a brush head of desired size and shape.

3 Claims, 27 Drawing Figures

Fig. 1
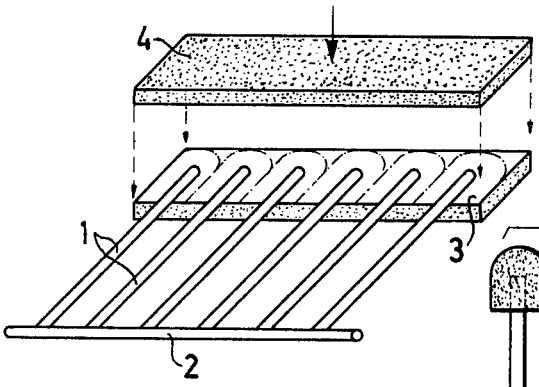
Fig. 2
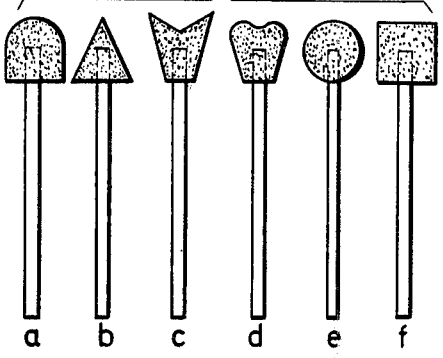
Fig. 3
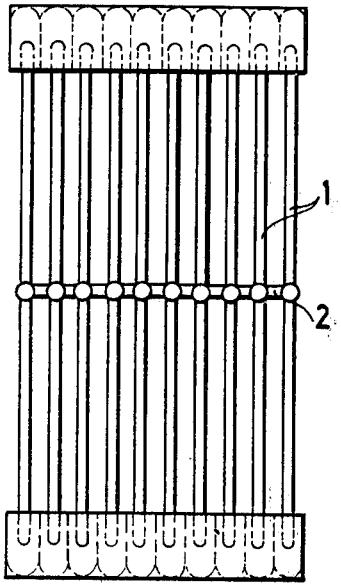
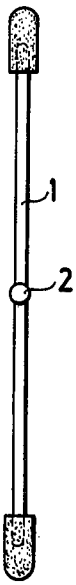
Fig. 4
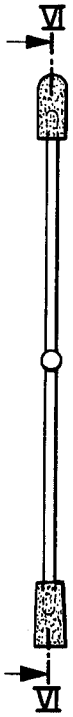
Fig. 5
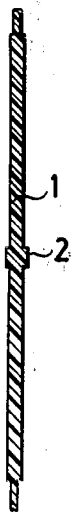
Fig. 6

Fig.7
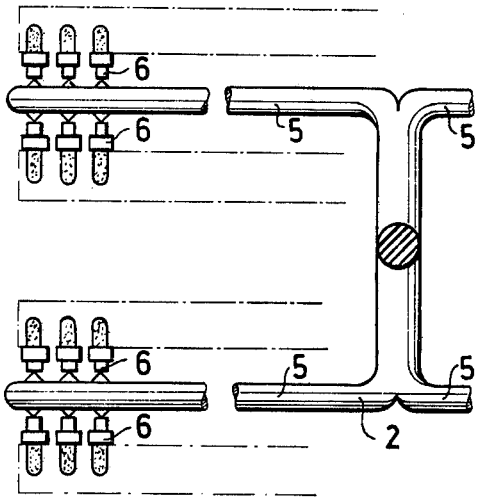
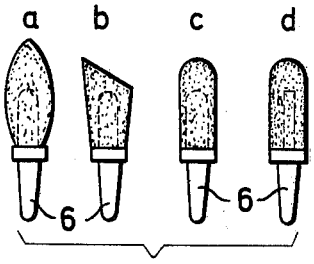
Fig.8
Fig.9
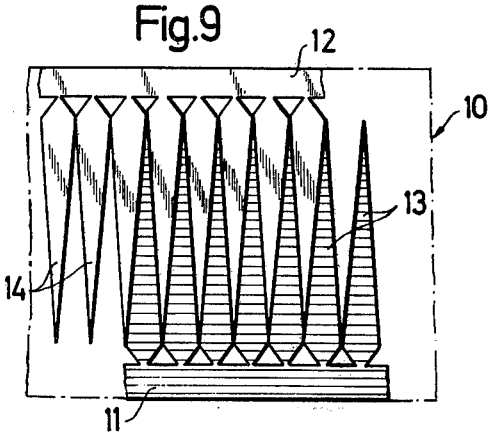
Fig.10
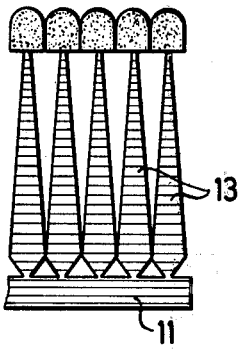
Fig.11
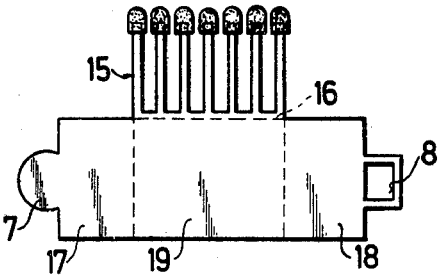

Fig.16a
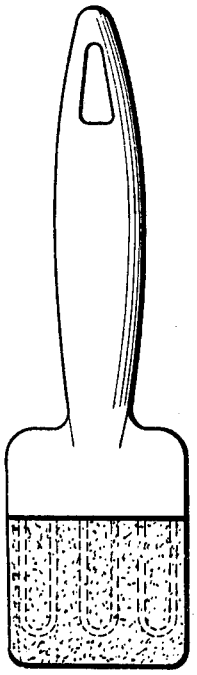
Fig.16b
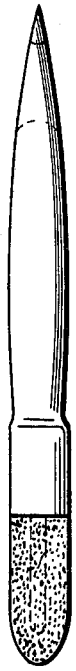
Fig.17
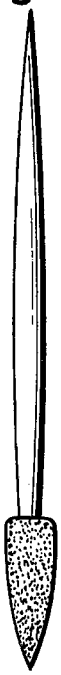
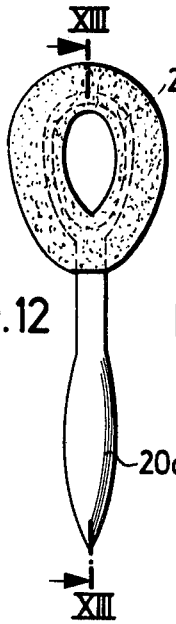
Fig. 12
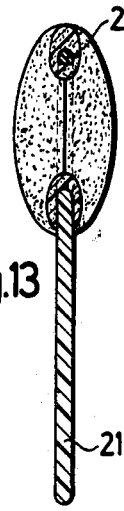
Fig.13
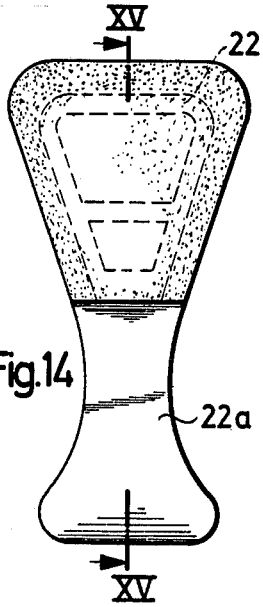
Fig.14
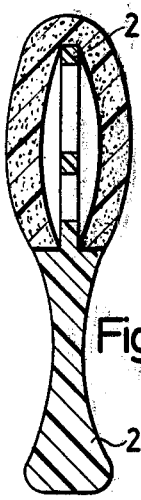
Fig.15

Fig.18a
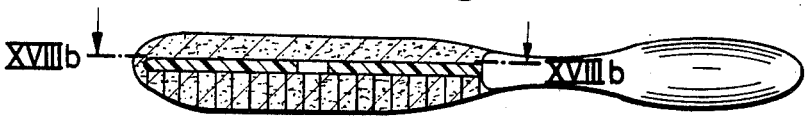
Fig.18b
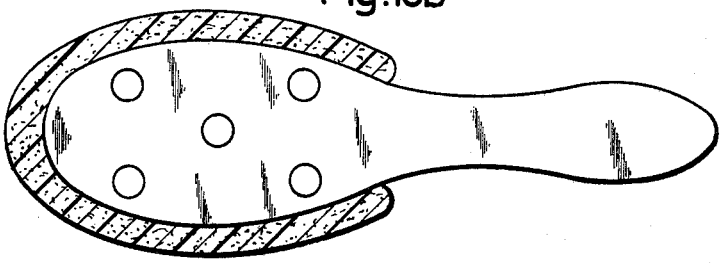
Fig.18
Fig.19a
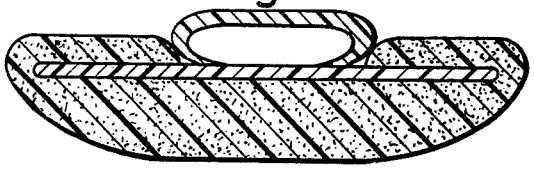
Fig.19b
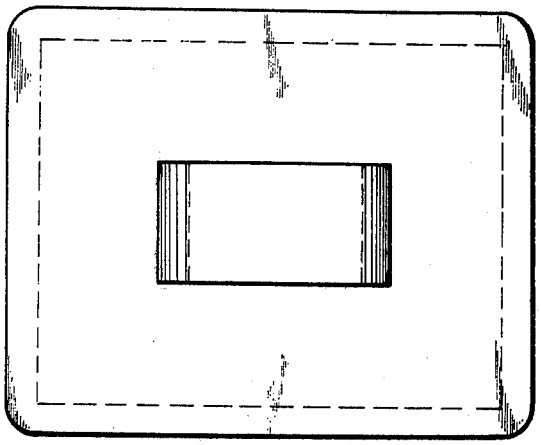
Fig.19

METHOD OF MANUFACTURING BRUSHES AND THE LIKE

BACKGROUND OF THE INVENTION

1. Field of the Invention

This invention relates to methods of manufacturing brushes.

2. Description of the Prior Art

German Pat. Specification No. 2,033,163 describes brushes having foam plastic heads. The heads are made first, either singly or several at a time, and a brush handle is then inserted into the finished head and secured in place therein. This individual joining of one head to one handle requires careful manipulation which is expensive.

SUMMARY OF THE INVENTION

According to the invention there is provided a method of manufacture of a plurality of brushes, the method comprising bringing foam plastics into contact with one end portion of each of a plurality of substantially parallel, spaced brush handles to surround the said end portion of each handle, and shaping and securing simultaneously the foam plastic to form a brush head on each handle.

Further according to the invention there is provided a method of manufacture of a plurality of brushes for painting, touching-up or the like, each brush consisting of an application head of foam plastic and a handle inserted by one end into the head, each head being produced by welding two small flat pieces of foam plastic together around the edges except for an opening for the insertion of the brush handle, wherein a group or plurality of brush handles is arranged in side-by-side, parallel relation with their said one ends lying on a first strip of foam plastic, a second sheet of foam plastic is then placed on the first strip of plastic and finally a multiple tool is used to stamp out the desired number of brushes simultaneously and weld them around their edges.

The brush handles are not inserted into ready-made heads. Insertion of the handles is combined with formation of the heads, for example by stamping or welding. This method of manufacture can be readily mechanised or automated. Foam plastic, for example in strip form, and a plurality of brush handles can be brought together at controlled time intervals, using known feed mechanisms and feed magazines. A multiple tool can then stamp out a batch of finished brushes in a single operation. Each group or plurality of parallel brush handles is preferably joined by one end to a common holding portion. This common holding portion can be used to bring the group of handles into the desired position for forming the heads.

The brush handles can be stamped in groups from a sheet of plastic. It is generally preferred to use a stamping pattern which enables two groups of brush handles, each group having a holding portion, to be stamped-out simultaneously, without waste, from a single sheet or slab of plastic. In this pattern, the holding portions form strips along opposite edges of the sheet. The brush handles extend from these holding portions towards the opposite side. The spaces between adjacent handles in one group form the handles in the other group.

Where the brush handles are injection molded in a multiple tool, the sprue from the mold can act as the holding portion of each group of brushes.

It is also possible to manufacture simply and automatically, complete packages of brushes in the form of a box blank, for folding around a group of brushes to form a flat carton. The carton can be molded or cast on to the holding portion common to a number of brush handles. The box blank and a group of handles can also be stamped from a single sheet of plastic. Once the foam plastic heads have been fitted, the box blank can then be folded around the group of brushes.

Brushes or the like can be cheaply mass-produced using a method in accordance with the invention. Foam plastic brushes have hitherto been proposed mainly for use in cosmetic purposes. However, the present invention can enable such brushes to be used in other fields, for example as school paint brushes. The foam plastic heads can be made of a shape to suit their intended use.

BRIEF DESCRIPTION OF THE DRAWINGS

Embodiments of brushes manufactured in accordance with the invention will now be described, by way of example, with reference to the accompanying diagrammatic drawings, wherein:

FIG. 1 is a plan view showing how the component parts of brushes can be arranged in manufacturing brushes in accordance with the invention;

FIGS. 2*a* to 2*f* show examples of brushes manufactured in accordance with the invention, each having a differently shaped head;

FIG. 3 shows a double arrangement of injection-molded handles for manufacturing brushes in accordance with the invention;

FIGS. 4 and 5 show two finished double handles as in FIG. 3;

FIG. 6 shows an injection-molded double handle viewed in the direction of the arrows VI—VI in FIG. 5;

FIG. 7 shows a multiple injection mold for school paint brushes;

FIGS. 8*a* to 8*d* show four embodiments of school paint brushes;

FIG. 9 shows a pattern for producing two groups of brush handles by stamping, and without waste, from a sheet of plastic;

FIG. 10 shows a group of finished, but joined, brushes manufactured using handles such as in FIG. 9;

FIG. 11 shows a group of brushes, complete with box blank, manufactured in accordance with the invention; and FIGS. 12 to 19 show various shapes of brushes manufactured in accordance with the invention, FIGS. 12 to 15 showing powder brushes, FIG. 16 showing a flat brush, FIG. 17 showing a school paint brush, FIG. 18 showing a clothes brush, and FIG. 19 showing a bath brush.

DESCRIPTION OF THE PREFERRED EMBODIMENTS

In FIG. 1, a group of brush handles 1 in parallel and spaced relation, is secured by the ends of the handles 1 remote from the brush heads to a common holding portion 2 so that all the handles can be manipulated by the holding portion 2. The end portions of handles 1 are laid on a strip of foam plastic 3 and a second strip of plastic 4 is then laid on top of the end portions. A stamping and welding tool can then be lowered onto the strips and foam plastic heads can be formed round each handle, as shown by the broken lines. Alternatively, a single strip of foam plastic twice as wide as the desired length of head may be folded along its longitudinal center line about the end portions of the handles and then stamped or welded.

As FIG. 2 shows, various brush shapes, for example as school paint brushes, can readily be manufactured in accordance with the present invention.

In the double arrangement shown in FIG. 3, brush handles are produced by injection molding of a plastic. The sprue in such a multiple molding forms a holding portion common to all the brushes.

In the case of the larger multiple mold shown in FIG. 7, four arms 5 are provided as in FIG. 3. Brush handles per se are generally not cast with such molds but instead relatively short intermediate members 6 are produced. One end of such member is for carrying the foam plastic head while the other end of the members can be interchangably inserted into brush handle proper.

FIG. 9 shows how two groups of brush handles can be stamped from one sheet of plastic 10. The holding portion 11 of one group lies along one edge of the sheet 10, while the holding portion 12 of the other group lies along the other edge. From the holding portions 11 and 12, the brush handles 13 and 14 extend across the sheet 10 at right angles to the holding portions 11 and 12. The handles 13 in the first group extend in the opposite direction to those 14 in the second group, one brush handle 14 in the latter group lying between two adjacent brush handles 13 in the first group. In this way, the plastic sheet 10 can be converted, substantially without waste, into brush handles plus holding portions 11 and 12.

FIG. 10 shows one group 15 of such brushes.

The flat fold-round box, and a group of brushes 15, shown in FIG. 11 can be stamped from a single sheet of plastic. When the brush heads have been fitted, the group of brushes can be turned over inwardly, along line 16, on to the wall 19 of the box. The two flaps 17 and 18 can then be turned over along pre-stamped fold lines and fastened together.

One particular advantage of the described method in which the brush handles are interconnected when formed is that handles placed in position before the stamping operation on the brush head tend to remain more firmly in place in the heads than handles subsequently inserted into the heads. Moreover, it is possible to fit handles which, due to their large dimensions, could not have been inserted into the heads subsequently.

FIGS. 12 to 15 show examples of brushes with relatively large heads, the heads being strengthened and held in shape in each instance by frame-like portions 20, 21, 22 and 23 respectively which form part of handles 20*a*, 21*a*, 22*a* and 23*a* respectively.

FIGS. 16 to 19 show further embodiments of brushes produced in accordance with the invention.

I claim:

1. A method of manufacturing a plurality of brushes, each brush comprising a handle and a head of foamed plastic material, said method comprising the steps of providing a plurality of handles arranged in parallel, coplanar, side-by-side relationship with one end portion of each handle lying intermediately on a first strip of foamed plastic material which extends perpendicular to the handles and which strip is more narrow than the length of a handle, placing a second strip of foamed plastic material on top of the first strip and in registration therewith, and stamping and welding the said strips to form the plastic material into a brush head on each handle while simultaneously separating the said brush heads from each other and securing the thus formed heads in enclosing relation to the said one end portion of the handles, said plurality of brush handles being first formed by stamping groups thereof from a sheet of plastic, the handles of each group remaining connected by the other end portion to a holding portion produced simultaneously from the same sheet of plastic and integral with the said handles.

2. A method according to claim 1, wherein two groups of handles are produced on each stamping operation, the holding portion of each group comprising a strip along a respective edge of the sheet of plastic, each group of handles extending from the respective holding portion toward the other holding portion, and the space between any two adjacent handles in each group including a handle in the other group.

3. A method as claimed in claim 1, in which a box blank including the group of side-by-side, parallel handles is formed simultaneously with the handles and integral therewith at said other end portions of the handles, the box being formed to include flaps which are foldable around the plurality of brushes to form a flat carton enclosing the brushes.

* * * * *